US007997558B1

(12) United States Patent
Miller

(10) Patent No.: US 7,997,558 B1
(45) Date of Patent: Aug. 16, 2011

(54) METHOD AND APPARATUS FOR LIFTING GO-KARTS

(76) Inventor: Richard Scott Miller, Bakersfield, CA (US)

( * ) Notice: Subject to any disclaimer, the term of this patent is extended or adjusted under 35 U.S.C. 154(b) by 0 days.

(21) Appl. No.: 12/729,574

(22) Filed: Mar. 23, 2010

(51) Int. Cl.
*B66F 5/00* (2006.01)

(52) U.S. Cl. ..... 254/2 B; 254/131; 254/5 B; 254/10 B

(58) Field of Classification Search ..... 254/2 B, 254/5 B, 8 R, 9 B, 10 R, 10 B, 21, 25, 131
See application file for complete search history.

(56) References Cited

U.S. PATENT DOCUMENTS 5,971,360 A * 10/1999 Sinsley ..... 254/8 B
6,056,272 A * 5/2000 Sayler ..... 254/131
6,260,824 B1 * 7/2001 Aderhold ..... 254/17
6,488,157 B2 * 12/2002 Chen ..... 211/20
6,802,493 B2 * 10/2004 Lance ..... 254/131
7,100,928 B1 * 9/2006 VanValkenburgh ..... 280/164.1
7,338,032 B2 * 3/2008 Sykes, Jr. ..... 254/25

* cited by examiner

*Primary Examiner* — Lee D Wilson
(74) *Attorney, Agent, or Firm* — James M. Duncan, Esq.; Klein, DeNatale, Goldner, et al.

(57) ABSTRACT

A lifting apparatus which removably attaches to the front tubular bumper of a go-kart, allowing a person lifting the front of the go-kart to lift more easily and without excessive bending of the back. The lifting apparatus has a handle member, and a bumper engagement structure which depends from the handle member. The bumper engagement structure is configured to removably attach to the parallel-oriented upper tube and lower tube which make up the front bumper of the go-kart.

9 Claims, 3 Drawing Sheets

METHOD AND APPARATUS FOR LIFTING GO-KARTS

BACKGROUND OF THE INVENTION

The present invention relates generally to go-karts propelled by gasoline engines and utilized in competitive racing events. As known by the participants and spectators of these events, the go-karts have a frame which is configured to seat a single driver. The go-kart, having small diameter wheels, has a frame which is very close to the ground. Depending upon the particular racing class, these vehicles are powered by a variety of different engine sizes, and can achieve relatively high speeds, such as in excess of 60 miles per hour.

A nose (or nose cone) generally covers the front of the go-kart typically running from outer wheel edge to outer wheel edge. Some varieties of nose only cover from inner wheel edge to inner wheel leaving both front wheels in the airstream. However, the rules of the sanctioning bodies typically require that the wheels be enclosed within the nose piece. Many shapes of nose piece are available and most are dependent on what is perceived as the most attractive. The height of the nose piece is only limited by the required view of the driver. Typically the nose piece will mount to the underside of the frame and/or bumper and typically is about 10 inches tall. Some drivers will also add a skirt to the edge of the nose allowing it to seal itself to the pavement.

The nose piece should redirect airflow around the kart and driver without generating additional drag or unwanted downforce or lift. Most of the airflow should be directed down the sides of the kart instead of over the top of the kart. Lift will be generated by airflow over the top of the kart unless the airflow is controlled well. The nose piece will see the highest aerodynamic load and should be stiff enough and mounted securely enough to support the aerodynamic loads without excessive deflections, which would prevent the nose piece from smoothly redirecting the airflow. Common construction materials for the nose are plastic, fiberglass and other composites. To prevent adverse aerodynamic effects, the nose should be centered and straight relative to the go-kart's central axis, and mounted to prevent excessive movement. Otherwise, the go-kart may pull to one side or the other. The angle of the nose piece relative to the ground is also important and can be used for tuning the go-kart's aerodynamics. The nose piece can either be neutral, such that it provides zero lift and zero downward force, or the nose can provide either lift or downward force. Minimum drag is be achieved with a neutral setting, but handling problems may be best solved by adjusting the angle of the nose relative to the ground.

Competitive racing events for go-karts are typically regulated under various rules set forth by sponsoring or sanctioning bodies, such as the International Kart Federation and World Karting Association. Among these rules are ones which impose specific design requirements for the go-karts to enhance the safety of the vehicles. Among the other safety requirements is the requirement that the vehicles have a front bumper. The front bumpers for go-karts are typically tubular, comprising a lower tube and an upper tube, where the lower tube and upper tube are in general parallel configuration at the front of the go-kart. Covering the front of the bumper is the nose piece, which extends across the front of the go-kart. The rules generally require that the front bumper, or other hardware, does not protrude in front of the nose piece of the go-kart. The covering of the front bumper by the nose is also preferred for the aerodynamic reasons discussed above.

While the above-discussed nose configuration for go-karts has both safety and aerodynamic features, it does present a problem for the kart operator and crew. The go-karts frequently have to be lifted for transportation or for placing the vehicle on a work table or bench. Lifting the go-kart typically requires a person lifting at the front and another lifting at the back. However, the person lifting at the front has limited hand-holds, because the nose piece covers much of the front bumper. The nose piece is not an acceptable handhold because of its light-weight construction and because movement of the nose piece can have adverse aerodynamic results, as discussed above. The only handholds reasonably available to a person lifting the front of this type of go-kart are the lower tube or upper tube of the front bumper. However, reaching these tuber members requires the person lifting at the front to have to lean over the nose piece and lift in an awkward position, as schematically illustrated in FIG. 1. Lifting in this manner can lead to back injuries potentially injuring their backs or dropping the front of the go-kart.

SUMMARY OF THE INVENTION

The disclosed method and apparatus comprises a lifting apparatus which removably attaches to the tubular bumper of a go-kart, there the go-kart comprises a front and a back, and four ground-engaging wheels, and the tubular bumper comprises a lower tube and an upper tube. The lower tube and upper tube of the tubular bumper are in general parallel configuration at the front of the go-kart. The lifting apparatus has a handle member. The handle member has a lifting end, which is the portion which is grasped by the person. The handle member also has an attachment end, so designated, because it transitions into the integral structure which attaches to the front of the go-kart. Adjacent to the attachment end is a structure which allows a mechanical advantage to the person lifting the front end. This structure acts as a fulcrum, allowing the handle member to act as a lever, thus this structure is referred to a fulcrum member. The handle member transitions into structure which allows the easy attachment of the apparatus to the tubular bumper of the go-kart. This structure, generally referred to as the bumper engagement means, comprises an upper end which, when attached, is adjacent to the upper tube of the tubular bumper, and a lower end which, when attached, abuts part of the back side of the lower tube. When placed in position for lifting the front of the go-kart, a part of the upper tube is bounded on its front side by the fulcrum member and bounded on its rear side by the upper end of the bumper attachment means. The bumper engagement means has attached at its lower end a lifting member which, when in position for lifting the go-kart, the lifting member abuts a part of the bottom side of the lower tube of the tubular bumper.

Also disclosed herein is a method for utilizing the above apparatus in lifting the front-end of a go-kart.

DETAILED DESCRIPTION OF THE EMBODIMENTS

Figure 1:
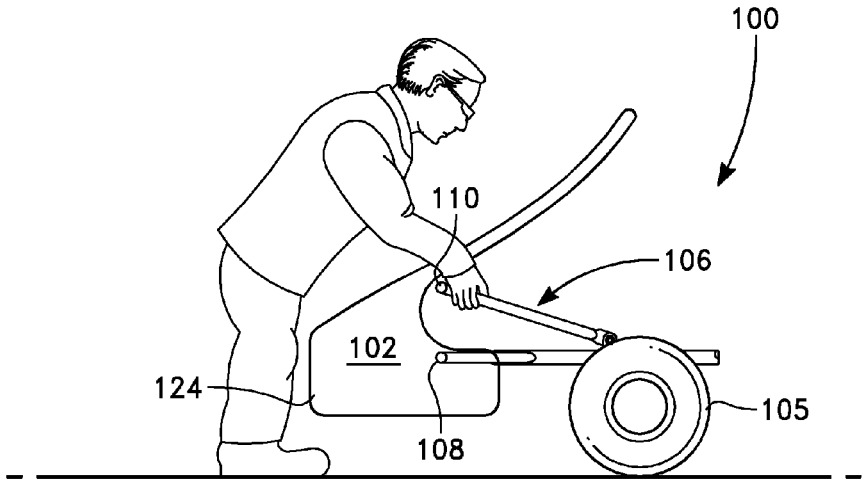
(Prior Art) FIG. 1
FIG. 1 schematically depicts the prior art method used for lifting the front of a go-kart having a nose piece, with a tubular bumper behind the nose piece.
Figure 3:
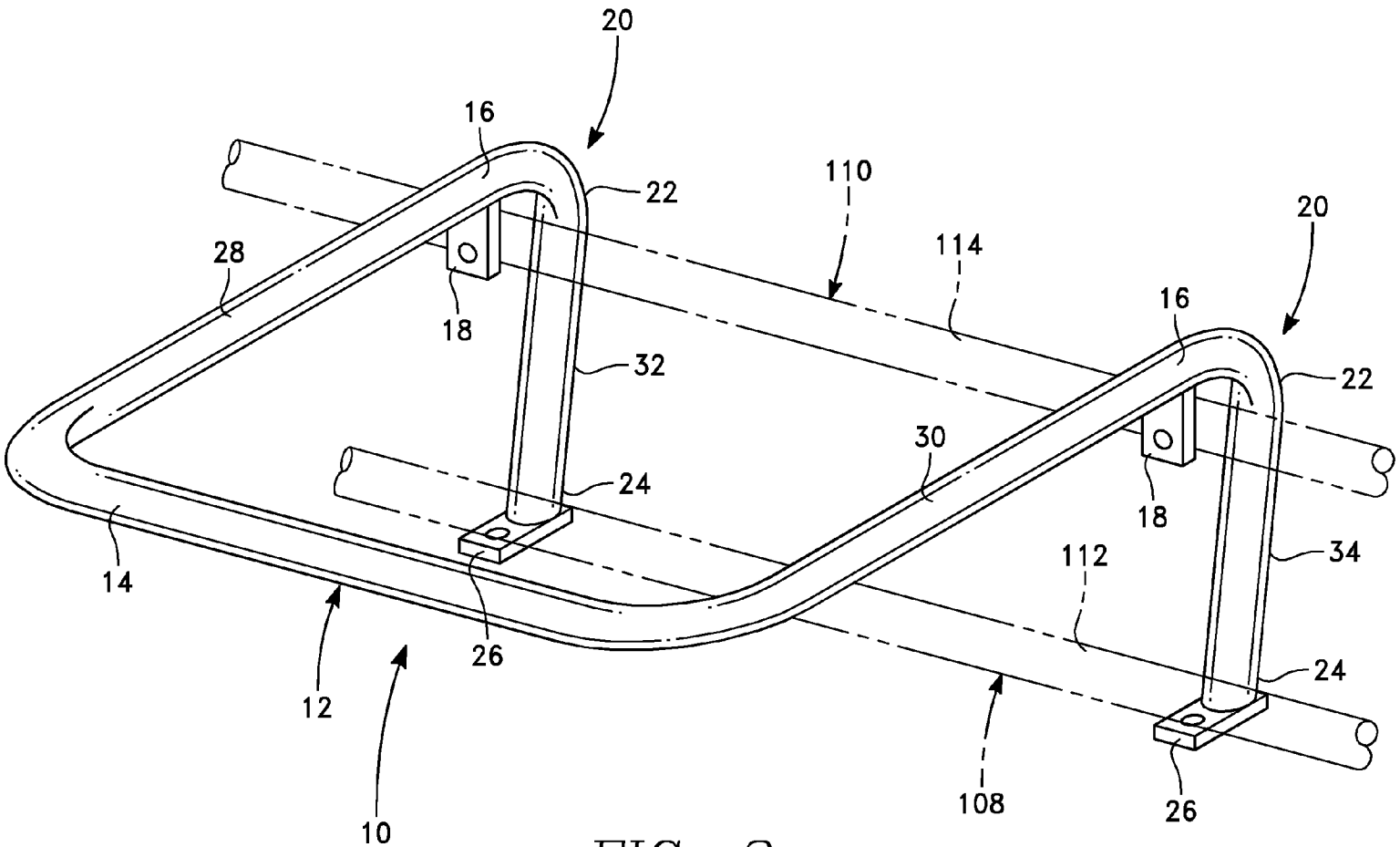
FIG. 3 shows a perspective view of the apparatus engaging the members of a tubular bumper.

Referring now to the figures, FIG. 1 shows the prior method of lifting the front end of a go-kart 100. This type of go-kart has a front 102 and a back 104, and four ground-engaging wheels 105. The go-kart also has a tubular bumper 106 comprising a lower tube 108 and an upper tube 110. As best shown in FIG. 3, the lower tube 108 and upper tube 110 are generally parallel from the perspective of the front 102 of the go-kart 100, while it can be seen that tubes will typically join together along the side of the chassis. The lower tube 108 and upper tube 110 each having a front side 112, 114 defined as the side facing the front 102 of the go-kart 100. The lower tube 108 and upper tube 110 also have a rear side 116, 118 defined as the side facing the back 104 of the go-kart 100. The lower tube 108 and upper tube 110 each also have a bottom side 120, 122, which is defined as the side facing toward the ground. As shown schematically in FIG. 1, the person lifting from the front 102 of the go-kart 100 must lean over the nose piece 124 in order to find a hand-hold on the tubular bumper 106 for lifting the go-kart. This requires the person to lift from his or her back and arms as opposed to lifting from the legs, making it very awkward to lift the go-kart, and potentially straining his or her back.

Figure 2:
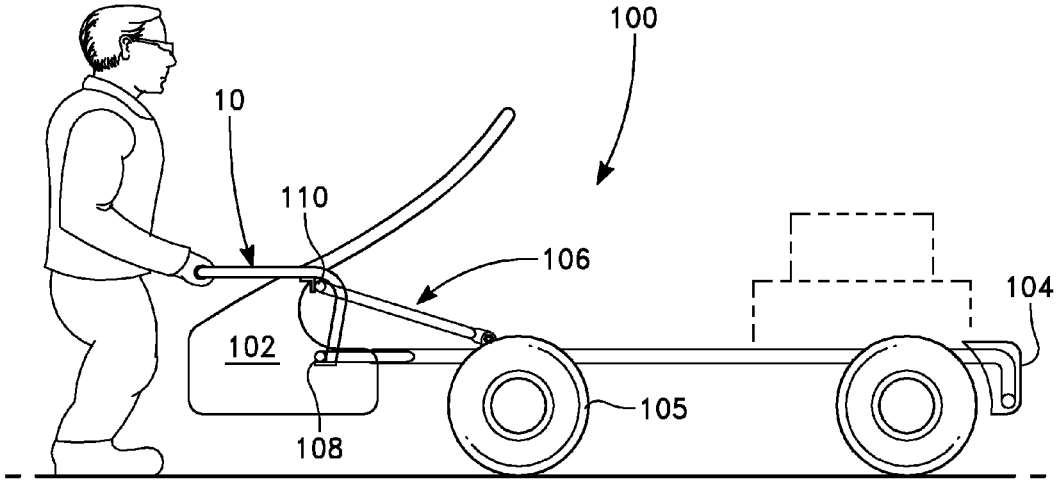
FIG. 2 schematically depicts how an embodiment of the disclosed apparatus may be employed for lifting the front of a go-kart having a nose piece, with a tubular bumper behind the nose piece.

As shown schematically in FIG. 2, the disclosed lifting apparatus 10 allows the person lifting the go-kart 100 to do so with his or her legs. Moreover, the device provides a mechanical advantage in lifting the go-kart 100. This mechanical advantage makes embodiments of the apparatus of benefit in lifting the front-end of a go-kart which does not have a nose piece 124.

As shown in FIG. 3, the apparatus comprises a handle member 12. The handle member has a lifting end 14, which is grasped by the user. The handle member 12 also has an attachment end 16, from which depends a bumper engagement means 20, i.e., structure for removably attaching to the tubular bumper 106. The handle member 12 further comprises at least one fulcrum member 18 which is adjacent to the attachment end 16. The previously referenced bumper engagement means 20 is integrally attached at the attachment end 16 of the handle member 12, depending there from.

The bumper attachment 20 means comprises suitable structure for removably attaching to the members of the tubular bumper 106. In most cases, this means structure which will removably attach to lower tube 108 and upper tube 110. The bumper attachment means 20 comprises an upper end 22 and a lower end 24. When the lifting apparatus is in position for lifting the go-kart 100, the lower end 24 abuts part of the back side 116 of the lower tube 108. A part of the upper tube 110 is bounded on its front side 114 by the fulcrum member 18 and bounded on its rear side 116 by the upper end 22, as shown in FIG. 3. The bumper attachment means 20 further comprises a lifting member 26 attached to the lower end 24. When the lifting apparatus 10 is in position for lifting the go-kart 100, the lifting member 26 abuts a part of the bottom side 120 of the lower tub 108.

While different handle configurations might be utilized, the embodiment of the apparatus shown in the figures comprises a handle member 12 having a left side arm 28 and a right side arm 30. As shown in the figures, the handle member may be u-shaped. However, it is to be appreciated that other shapes, such as a vee shape, or a split handle configuration might be utilized. In the embodiment shown in FIG. 3, the left side arm 28 may comprise a left side fulcrum member 18 and the right side arm 30 may comprise a right side fulcrum member 18, which may be identical to the that on the left side arm for ease of manufacturing. In the embodiment shown in FIG. 3, the bumper attachment means 20 comprises a left side bumper engagement member 32 and a right side bumper engagement member 34.

Figure 4:
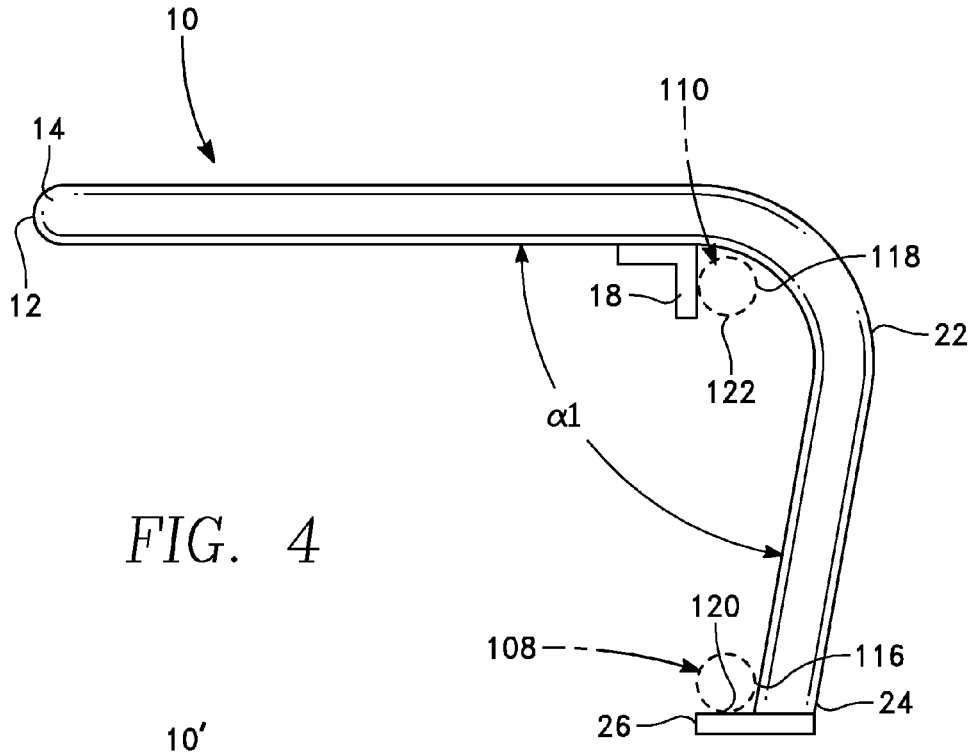
FIG. 4 shows an embodiment of the lifting apparatus.
Figure 5:
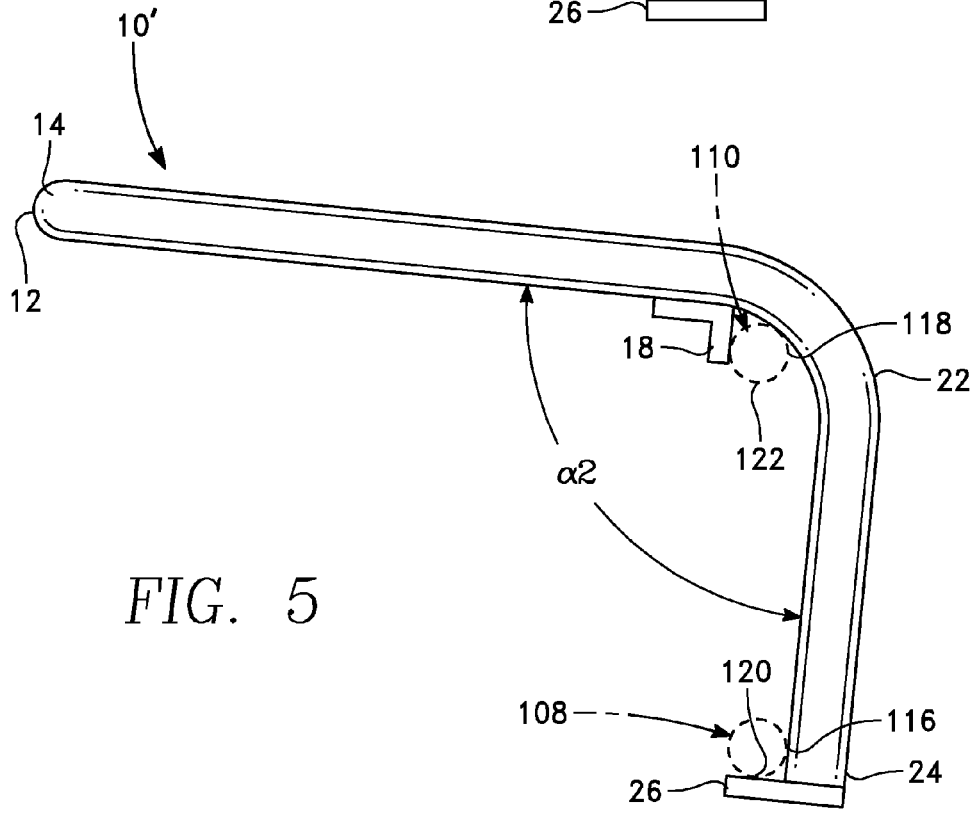
FIG. 5 shows an alternative embodiment of the lifting apparatus

FIGS. 4 and 5 depict different embodiments of the lifting apparatus 10, 10'. In these embodiments, it is to be noted that an angle is defined by position of the right side bumper engagement member 34 with respect to the right side arm 30 (where a similar angles are defined by the positions of the left side bumper engagement member 32 with respect to the left side arm 28). While this angles may be modified according to the bumper configuration of the particular go-kart and the physical attributes of the person lifting the front of the go-kart, this angle will typically be more than 60 degrees but not more than 90 degrees. Some angle will generally be utilized. For example, angle $\alpha 1$ in FIG. 4 is approximately 80 degrees, while angle $\alpha 2$ in FIG. 5 is approximately 90 degrees.

A method of utilizing the lifting apparatus for lifting the front 102 of a go-kart 100 comprises the use of a lifting apparatus 10 as described above and within the figures and maneuvering the device to the front of the go-kart in close proximity to the tubular bumper 106. The lifting apparatus 10 is attached to the tubular bumper 106 by causing the lower end 24 of the bumper engagement means 20 to abut a portion of the back side 116 of the lower tube 108 while, nearly simultaneously, engaging a portion of the upper tube 110 between the fulcrum member 18 and the upper end 22 of the bumper attachment means 20. The person thereafter grasps the handle member 12 and lifts at the handle, preferably using his or her legs for the lifting. The front of the go-kart is thus lifted for the intended purpose.

While the above is a description of various embodiments of the present invention, further modifications may be employed without departing from the spirit and scope of the present invention. Thus the scope of the invention should not be limited according to these factors, but according to the following appended claims.

What is claimed is:

1. A method for lifting the front of a go-kart, the go-kart comprising a front and a back, four ground-engaging wheels, and a tubular bumper on the front of the go-kart, where the tubular bumper comprises a lower tube and an upper tube, the lower tube and upper tube in general parallel configuration at the front of the go-kart, the lower tube and upper tube each having a front side defined as the side facing the front of the go-kart, a rear side defined as the side facing the back of the go-kart, and a bottom side defined as the side facing toward the ground, the method comprising the following steps:

maneuvering a lifting apparatus to the front of the go-kart in close proximity to the tubular bumper, where the lifting apparatus comprises a handle member being u-shaped with left and right side arms, a fulcrum member attached to the handle member wherein said fulcrum member is substantially perpendicular to said right and left arms, and a bumper engagement means integrally attached to the handle member being located at an end of said left and right arms extending therefrom with a curvature thereinbetween, where the bumper attachment means comprises an upper end, a lower end, and a lifting member attached to the lower end;

attaching the lifting device to the tubular bumper by causing the lower end of the bumper engagement means to abut a portion of the back side of the lower tube while engaging a portion of the upper tube between the fulcrum member and the upper end of the bumper attachment means;

grasping the handle member; and lifting the handle member, thereby raising the front of the go-kart.

2. The method of claim 1 wherein the fulcrum member comprises an aperture.

3. The method of claim 1 wherein the attachment means having a curvature being substantially 90 degrees.

4. The method of claim 2 wherein the left side arm comprises a left side fulcrum member and the right side arm comprises a right side fulcrum member.

5. The method of claim 2 wherein the bumper attachment means comprises a left side bumper engagement member and a right side bumper engagement member.

6. The method of claim 5 wherein the left side bumper engagement member has an upper end connected to the left side arm and the right side bumper engagement member has an upper end connected to the right side arm.

7. The method of claim 6 wherein the left side bumper engagement member has a first lower end with a left side lifting member attached to the first lower end and the right side bumper engagement member has a second lower end with a right side lifting member attached to the second lower end.

8. The method of claim 1 wherein the attachment means having a curvature being substantially less than 90 degrees.

9. The method of claim 1 wherein the lifting member comprises an aperture.

* * * * *